US009625160B2

(12) United States Patent
Xiao

(10) Patent No.: US 9,625,160 B2
(45) Date of Patent: Apr. 18, 2017

(54) HINGE

(71) Applicant: Yousong Xiao, Shenzhen (CN)

(72) Inventor: Yousong Xiao, Shenzhen (CN)

(73) Assignee: Union Industry Investment (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/785,287

(22) PCT Filed: Apr. 18, 2013

(86) PCT No.: PCT/CN2013/074353
§ 371 (c)(1),
(2) Date: Oct. 16, 2015

(87) PCT Pub. No.: WO2014/169457
PCT Pub. Date: Oct. 23, 2014

(65) Prior Publication Data
US 2016/0083992 A1 Mar. 24, 2016

(51) Int. Cl.
*F24C 15/02* (2006.01)
*E05F 1/10* (2006.01)
(Continued)

(52) U.S. Cl.
CPC ..... *F24C 15/023* (2013.01); *E05D 3/02* (2013.01); *E05D 13/1207* (2013.01); *E05F 1/10* (2013.01);
(Continued)

(58) Field of Classification Search
CPC ..... F24C 15/023; E05F 1/10; E05F 1/1008; E05F 1/1016; E05F 1/1025; E05F 1/1033;
(Continued)

(56) References Cited

U.S. PATENT DOCUMENTS 4,269,165 A 5/1981 Wrotny et al.
4,817,240 A * 4/1989 Sovis, Jr. ..... E05D 11/1014 126/194
(Continued)

FOREIGN PATENT DOCUMENTS

CN 201521184 7/2010
CN 201695837 1/2011
(Continued)

OTHER PUBLICATIONS

International Search Report and Written Opinion for International Application PCT/CN2013/074353, dated Jan. 30, 2014, 8 pgs.

*Primary Examiner* — Jeffrey O Brien
(74) *Attorney, Agent, or Firm* — Hamre, Schumann, Mueller & Larson, P.C.

(57) ABSTRACT

A hinge includes a hinge arm (1) and a hinge base (6) fitting with the hinge arm. A support (2) is disposed between the hinge arm (1) and the hinge base. A first end of the support is movably connected to the hinge arm, and a second end is movably disposed with the hinge base (6). A locking position (12) is disposed on the hinge arm. A connecting piece (4) is disposed in fitting with the locking position. A first end of the connecting piece is movably connected to the body of the support, and a second end is movably connected to a first end of a rocking bar (7). The body portion of the rocking bar (7) is movably connected coaxially to a second end of the support (2) and the hinge base (6). A connecting shaft (72) is disposed on a second end of the rocking bar. A first end of a spring (3) is hung to the connecting shaft, and the other end of the spring is hung to a hanging shaft (62) that is disposed fixedly with the hinge base. Because of the connecting spring, the connecting piece and the support on the key component rocking bar, by adjusting a hole position of a connecting rivet and a force of the spring, a balancing force
(Continued)

and a buffering force can be provided for gates with different weights in a changing way, and the adaptability is good.

8 Claims, 2 Drawing Sheets

(51) Int. Cl.
*E05F 1/12* (2006.01)
*E05D 3/02* (2006.01)
*E05D 13/00* (2006.01)

(52) U.S. Cl.
CPC ..... *E05F 1/1041* (2013.01); *E05F 1/1058* (2013.01); *E05F 1/1075* (2013.01); *E05F 1/1276* (2013.01); *E05Y 2900/308* (2013.01); *Y10T 16/53833* (2015.01); *Y10T 16/53834* (2015.01)

(58) Field of Classification Search
CPC ..... E05F 1/1041; E05F 1/105; E05F 1/1058; E05F 1/1066; E05F 1/1075; E05F 1/1083; E05F 1/1246; E05F 1/1253; E05F 1/1261; E05F 1/1269; E05F 1/1276; Y10T 16/53833; Y10T 16/53834
See application file for complete search history.

(56) References Cited

U.S. PATENT DOCUMENTS 5,025,776 A * 6/1991 Hanley ..... E05F 1/1276 126/194
7,134,169 B2 * 11/2006 Habegger ..... E05D 7/123 126/191
7,676,888 B2 * 3/2010 Vanini ..... E05F 5/10 16/277
7,721,388 B2 * 5/2010 Lee ..... E05F 1/1276 16/286
8,250,706 B2 * 8/2012 Vanini ..... E05F 1/1261 16/277
8,266,765 B2 * 9/2012 Donoho ..... E05F 1/1276 16/286
8,677,565 B2 * 3/2014 Vanini ..... A47L 15/4261 16/286
8,806,718 B2 * 8/2014 Elkasevic ..... E05F 1/1261 16/286
8,925,542 B2 * 1/2015 White ..... E05F 1/1261 126/190
9,138,056 B2 * 9/2015 Kwon ..... A47B 95/02
9,145,722 B2 * 9/2015 Gherardi ..... E05D 11/08
9,157,262 B2 * 10/2015 Lee ..... E05D 3/12
9,181,741 B2 * 11/2015 Bettinzoli ..... E05F 1/1261
9,316,036 B2 * 4/2016 Collene ..... E05F 1/1058
2007/0209654 A1 * 9/2007 Wang ..... E05F 1/1276 126/194
2010/0251521 A1 * 10/2010 Donoho ..... E05D 11/06 16/343
2011/0072617 A1 * 3/2011 Lin ..... E05F 5/006 16/298
2011/0316401 A1 * 12/2011 Cummins ..... E05F 1/1066 312/319.2
2013/0180081 A1 * 7/2013 Salice ..... E05F 1/10 16/64
2016/0333620 A1 * 11/2016 Holzapfel ..... E05F 1/1058

FOREIGN PATENT DOCUMENTS

DE 1243561 6/1967
EP 0204153 12/1986
FR 1255268 3/1961

* cited by examiner

HINGE

BACKGROUND

Technical Field

This utility model relates to a hinge, and in particular, to a hinge used for an oven door body.

Related Art

With gradual improvement of living standards of people, an oven used for making and cooking food is also gradually becoming a tool for everyday life of people. An oven includes an oven body and a door body that is installed at a front side of the oven body. During a using process, the door body is opened first, then food is put into the oven and the door body is closed, and the food is baked. For a common oven, the oven body and the door body are connected by using a common hinge. When the door body is closed, the door body is fastened to the oven body and covers the oven body. When the door body is opened, the door body stays in a horizontal state. A user needs to give a certain supporting force on the door body to make the door body to stay on a position of any angle. After the oven is used and needs to cool down, the door body can only be opened totally in a horizontal state, which occupies larger space and causing inconvenience to the user.

Certainly, all these hinges mostly depend on a pulling force of a spring, and a manner of twisting pulling is used. When the door needs to be opened, the oven door is being opened and the spring is pulled, and opening of the oven door is implemented. When the oven door needs to be closed, it is only needed to let the oven door free, and the oven door is closed because of a resetting function of the spring. In actual use, because resetting of the spring has a certain accelerated speed, at the moment when the oven door is nearly closed, the oven door has largest kinetic potential energy and a relatively large speed, and the oven is easy to be damaged if the oven is stroke in such way for a long time. A common method is to label a door sill with a damping material, such as sponge; however, the spring under this practice still has large potential energy, and is still easy to be damaged. In conclusion, a problem needing to be solved currently is to develop an oven hinge that can slow down automatically at a certain position and avoid striking an oven door sill, which damages a door sill or a hinge easily; certainly, for example, although an oven hinge mentioned in the public application CN201020193660.3 can solve the foregoing problem, but a structure is complicated, and for ovens of different types, overall adjustment needs to be made further for application.

SUMMARY

An objective of the present utility model is to provide a hinge structure that has a simple structure and can provide, for an oven door body, a balancing force and a buffering force within a relatively large angle and can have a certain holding pressure when the door body is being closed.

To achieve the foregoing objective, the present utility model uses the following technical solutions:

This hinge includes a hinge arm and a hinge base fitting with the hinge arm, where a support is disposed between the hinge arm and the hinge base; a first end of the support is movably connected to the hinge arm, and a second end is movably disposed with the hinge base; a locking position is disposed on the hinge arm; a connecting piece is disposed in fitting with the locking position; a first end of the connecting piece is movably connected to the body of the support, and a second end is movably connected to a first end of a rocking bar; the body portion of the rocking bar is movably connected coaxially to a second end of the support and the hinge base; a connecting shaft is disposed on a second end of the rocking bar; a first end of a spring is hung to the connecting shaft, and the other end of the spring is hung to a hanging shaft that is disposed fixedly with the hinge base.

The body portion of the rocking bar, the second end of the support, and the hinge base are fixedly connected by using a same shaft, and a shaft sleeve is disposed separately at positions at which two ends of the shaft are in contact with the hinge base.

An elliptic elongated groove is disposed on the hinge base, and the shaft is disposed in the elongated groove.

The hinge arm and the first end of the support are movably connected by using a support rivet.

The connecting piece is disposed in the support in a locking manner, groove holes are disposed on two parallel side faces that are on the support and close to the first end, a roller shaft runs through the first end of the connecting piece and the groove hole, a roller is disposed on the roller shaft, and the roller is disposed in fitting with the locking position.

The first end of the rocking bar and the second end of the connecting piece are movably connected by using a rocking bar rivet.

The hinge arm and the hinge base are movably connected by using a hinged rivet and a hinged sleeve that is sleeved on the hinged rivet.

The connecting shaft and the hanging shaft are both rivets.

By using the foregoing technical solutions, this utility model has the following beneficial effects:

By using the foregoing simple structure, it can be ensured that the hinge maintains a balancing angle between 25° and 85° when a door body is opened; when a door is being opened, the hinge pulls a spring by rotating a hinge arm, and provides a supporting force to a roller by using a connecting piece and a support, and the hinge arm and the door can stop at any angle between 25° and 40°; when the door is being closed, the door causes the hinge arm to rotate, a tension force of the spring provides a pressure to the roller by using the connecting piece and the support, the roller presses on an inclined surface of the hinge arm, so that the door is quickly closed within 25°, and the door has a certain holding pressure, and therefore the door body can be opened and closed in a safer and more stable and convenient way; in addition, because of a connecting spring, the connecting piece and the support on a key component rocking bar, by adjusting a hole position of a connecting rivet and a force of the spring, a balancing force and a buffering force can be provided for gates with different weights in a changing way, and the adaptability is good.

DETAILED DESCRIPTION

The utility model is further described below with reference to the accompanying drawings.

Figure 1:
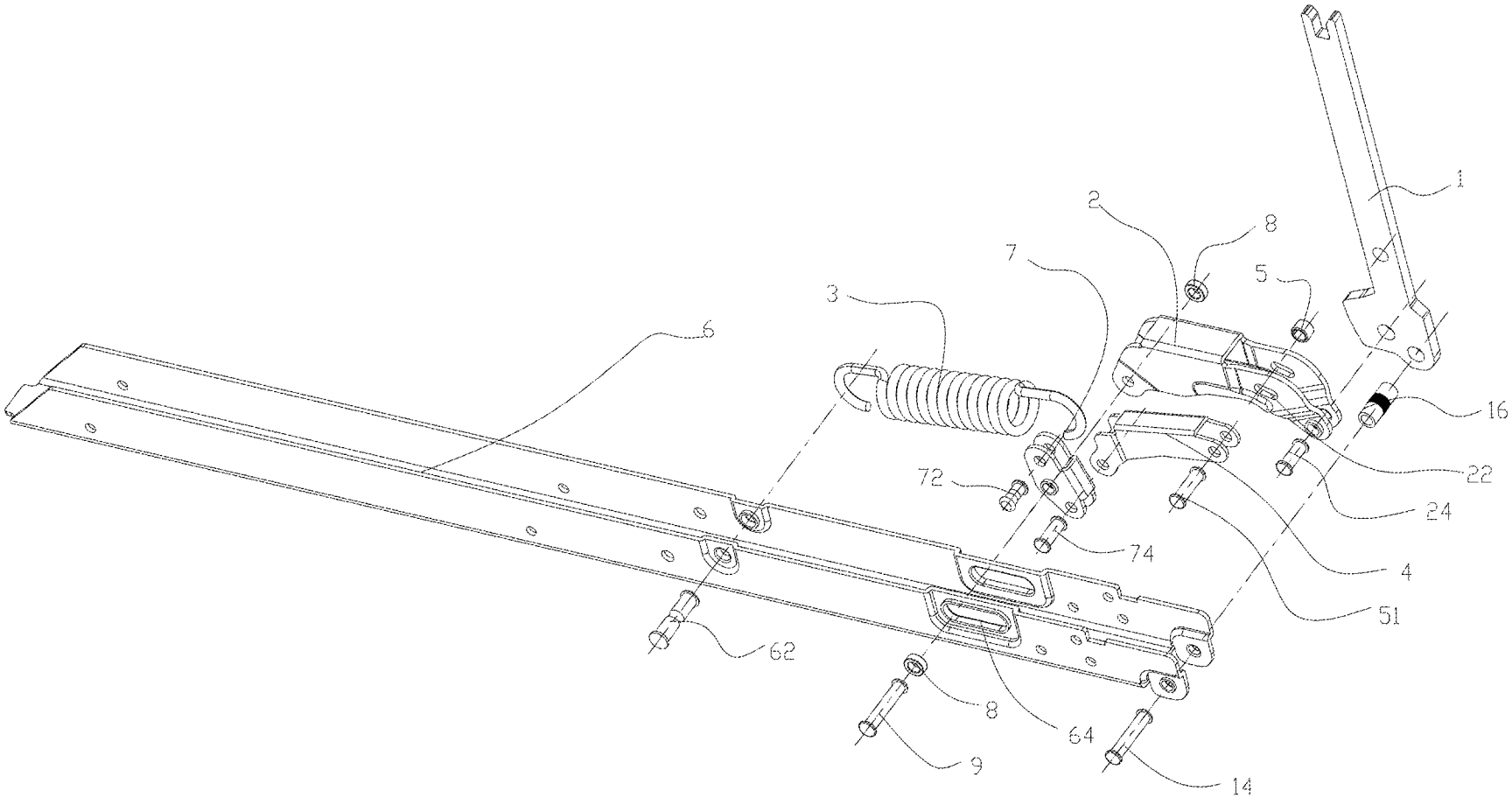
FIG. 1 is a three-dimensional assembly diagram of a hinge.
Figure 2:
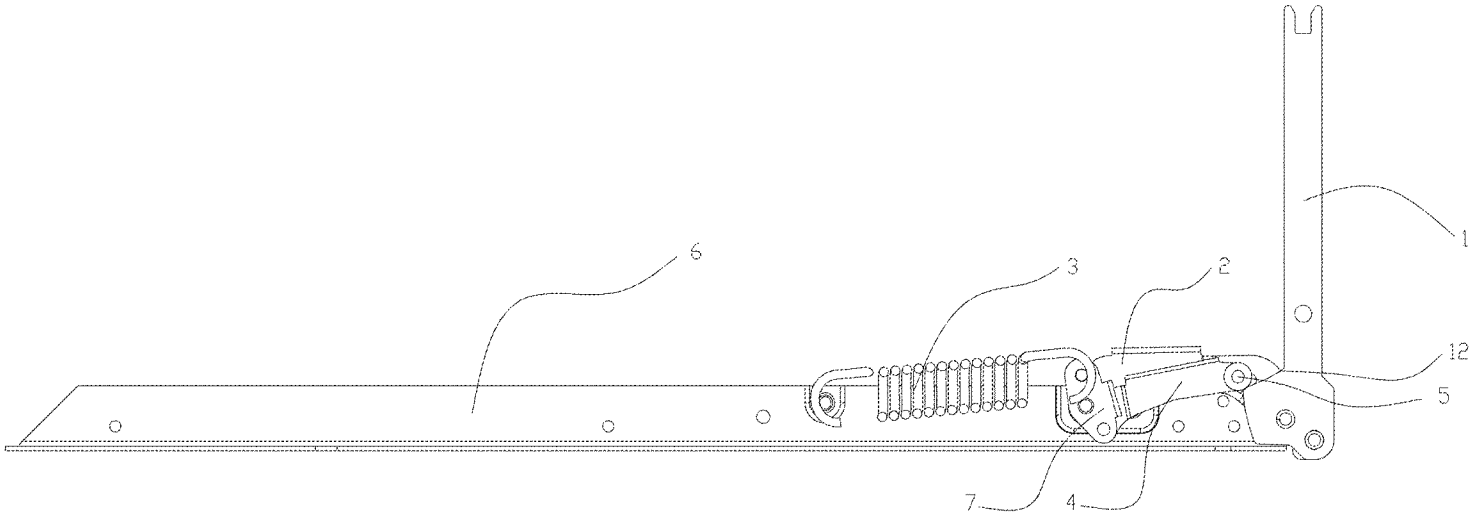
FIG. 2 is a main view of a hinge when a door body is closed.
Figure 3:
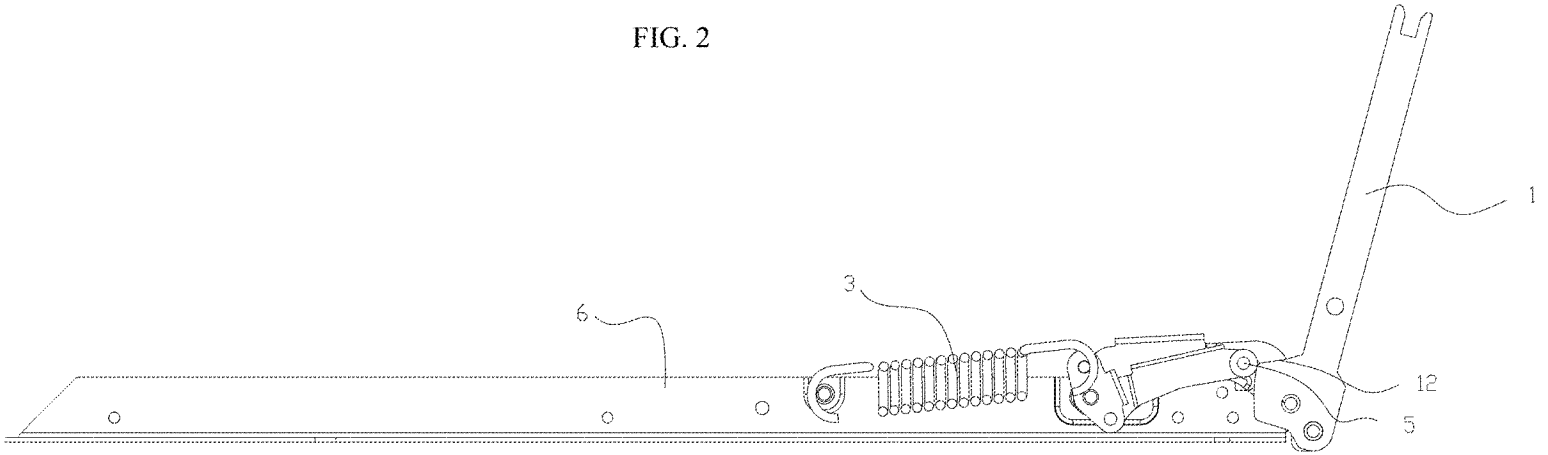
FIG. 3 is a main view of a hinge when a door body is opened.

As shown in FIG. 1 to FIG. 3, a hinge includes a hinge arm 1 and a hinge base 6 fitting with the hinge arm, where a support 2 is disposed between the hinge arm and the hinge base; a first end of the support is movably connected to the hinge arm, and a second end is movably disposed with the hinge base; a locking position 12 is disposed on the hinge arm; a connecting piece 4 is disposed in fitting with the locking position; a first end of the connecting piece is movably connected to the body of the support, and a second end is movably connected to a first end of a rocking bar 7; the body portion of the rocking bar 7 is movably connected coaxially to a second end of the support 2 and the hinge base 6; a rivet is disposed on a second end of the rocking bar 7 as a connecting shaft 72; a first end of a spring 3 is hung to the connecting shaft, the other end of the spring is hung to a hanging shaft 62 that is disposed fixedly with the hinge base, and the hanging shaft is also a rivet. Specifically, the body portion of the rocking bar 7, the second end of the support 2, and the hinge base 6 are fixedly connected by using a same shaft 9, and a shaft sleeve 8 is disposed separately at positions at which two ends of the shaft are in contact with the hinge base. An elliptic elongated groove 64 is disposed on the hinge base, and the shaft 9 is disposed in the elongated groove. The hinge arm and the first end of the support are movably connected by using a support rivet 24. The connecting piece 4 is disposed in the support 2 in a locking manner, groove holes 22 are disposed on two parallel side faces that are on the support 2 and close to the first end, a roller shaft 51 runs through the first end of the connecting piece and the groove hole, a roller 5 is disposed on the roller shaft, and the roller is disposed in fitting with the locking position. The first end of the rocking bar 7 and the second end of the connecting piece 4 are movably connected by using a rocking bar rivet 74. The hinge arm 1 and the hinge base 6 are movably connected by using a hinged rivet 14 and a hinged sleeve 16 that is sleeved on the hinged rivet. The connecting shaft 72 and the hanging shaft 62 are both rivets.

When in use, an oven door is pulled, that is, the hinge arm 1 is caused to rotate around the hinge base 6. A high spot of the locking position 12 is originally disposed under the roller 5. When an angle between the hinge arm and the hinge base reaches a certain degree, the high spot of the locking position 12 trips under the roller 5, and a side face of the locking position and a side face of the roller press against each other to form a new balance; in this process, because rotation of the hinge arm causes linked motion of the support, the connecting piece, and the rocking bar, the spring returns to an original state from a pulling state as long as a specific range of rotation of the hinge arm is between 25° and 85°. Meanwhile, because the hinge pulls the spring by rotating the hinge arm, and provides a supporting force to the roller by using the connecting piece and the support, the hinge arm and the door can stop at any angle between 25° and 40°; when the door is being closed, the door causes the hinge arm to rotate, a tension force of the spring provides a pressure to the roller by using the connecting piece and the support, the roller presses on an inclined surface of the hinge arm, so that the door is quickly closed within 25°, and the door has a certain holding pressure and can be closed slowly; besides, because the hinge base is provided with the elliptic elongated groove, so that the spring can adjust a forces at each angle by pulling of the support; the shaft is disposed in fitting with the elongated groove, and a shaft sleeve is disposed separately at two sides, so that the shaft rolls inside a hole, and wear resistance performance of a contact piece can be improved.

What is claimed is:

1. A hinge, comprising a hinge arm and a hinge base fitting with the hinge arm, wherein a support is disposed between the hinge arm and the hinge base; a first end of the support is movably connected to the hinge arm, and a second end is movably disposed with the hinge base; a locking portion is disposed on the hinge arm; a connecting piece is disposed in fitting with the locking portion; a first end of the connecting piece is movably connected to a body of the support, and a second end is movably connected to a first end of a rocking bar; a body portion of the rocking bar is movably connected coaxially to a second end of the support and the hinge base; a connecting shaft is disposed on a second end of the rocking bar; a first end of a spring is hooked on the connecting shaft, and the other end of the spring is hooked on a hanging shaft that is disposed fixedly with the hinge base.

2. The hinge according to claim 1, wherein the body portion of the rocking bar, the second end of the support, and the hinge base are fixedly connected by using a same shaft, and a shaft sleeve is disposed separately at positions at which two ends of the shaft are in contact with the hinge base.

3. The hinge according to claim 2, wherein an elliptic elongated groove is disposed on the hinge base, and the shaft is disposed in the elongated groove.

4. The hinge according to claim 1, wherein the hinge arm and the first end of the support are movably connected by using a support rivet.

5. The hinge according to claim 1, wherein the connecting piece is disposed in the support in a locking manner, groove holes are disposed on two parallel side faces that are on the support and adjacent to the first end, a roller shaft runs through the first end of the connecting piece and the groove holes, a roller is disposed on the roller shaft, and the roller is disposed in fitting with the locking portion.

6. The hinge according to claim 1, wherein the first end of the rocking bar and the second end of the connecting piece are movably connected by using a rocking bar rivet.

7. The hinge according to claim 1, wherein the hinge arm and the hinge base are movably connected by using a hinged rivet and a hinged sleeve that is sleeved on the hinged rivet.

8. The hinge according to claim 1, wherein the connecting shaft and the hanging shaft are both rivets.

* * * * *